US006030032A

United States Patent [19]

Tseng

[11] Patent Number: 6,030,032

[45] Date of Patent: Feb. 29, 2000

[54] ARMREST FOR A CHAIR

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 09/234,002

[22] Filed: Jan. 19, 1999

[51] Int. Cl.[7] ..... A47C 5/10

[52] U.S. Cl. ..... 297/38; 297/39; 297/28; 403/110

[58] Field of Search ..... 297/38, 39, 35, 297/411.43, 27, 28; 403/109.1, 109.8, 110

[56] References Cited

U.S. PATENT DOCUMENTS

| | | | |
|---|---|---|---|
| 2,294,967 | 9/1942 | Eberhardt | 403/110 |
| 2,571,463 | 10/1951 | Lorenz | 297/38 X |
| 2,729,277 | 1/1956 | Rechler | 297/39 |
| 5,570,926 | 11/1996 | Papiernik et al. | 297/39 |

FOREIGN PATENT DOCUMENTS

| | | | |
|---|---|---|---|
| 230577 | 4/1963 | Australia | 297/39 |
| 492371 | 4/1953 | Canada | 297/28 |
| 1137513 | 1/1957 | France | 403/110 |
| 693552 | 6/1940 | Germany | 297/28 |
| 13102 | 5/1925 | Netherlands | 403/110 |
| 954606 | 4/1964 | United Kingdom | 297/27 |

*Primary Examiner*—Peter M. Cuomo
*Assistant Examiner*—David E. Allred
*Attorney, Agent, or Firm*—Ladas & Parry

[57] ABSTRACT

An armrest for a chair includes an armrest frame formed with an elongated channel with a bottom opening, a hollow mounting seat disposed in the channel, and a shaft extending slidably through the mounting seat along an axis parallel to the armrest frame and having opposite ends secured to the armrest frame. The mounting seat has inner surfaces formed with retaining grooves that are registered with one another. Each of the retaining grooves is defined by a front vertical shoulder and a rear inclined shoulder. The inclined shoulder inclines downwardly and forwardly relative to the vertical shoulder. A locking plate is disposed in the mounting seat, and extends into the retaining grooves. The locking plate is formed with a locking hole between upper and lower sections thereof. The locking hole is slightly larger than cross-section of the shaft to permit extension of the shaft therethrough. The locking plate is movable between a locking position, in which the locking plate abuts against the inclined shoulders such that a peripheral wall that defines the locking hole frictionally engages the shaft, and a releasing position, in which the locking plate is disengaged from the shaft. A biasing spring biases the locking plate to the locking position.

4 Claims, 5 Drawing Sheets

ARMREST FOR A CHAIR

BACKGROUND OF THE INVENTION

1. Field of the Invention

This invention relates to an armrest for a chair, more particularly to an armrest which permits stepless adjustment of the inclination of a back frame of the chair.

2. Description of the Related Art

FIG. 1 illustrates a conventional chair which includes a horizontal seat frame 11, a generally upright back frame 12 pivoted to the seat frame 11, a pair of leg frames 13 (only one is shown), and a pair of armrests 15 (only one is shown) above the seat frame 11. Each of the leg frames 13 has a top end provided with an engaging member 14. Each of the armrests 15 has a rear end mounted pivotally on the back frame 12, and a bottom side formed with a longitudinal slide channel 151 and a series of engaging grooves 152 communicated with the slide channel 151. The armrests 15 are movable forwardly and rearwardly for engaging the engaging members 14 with a selected pair of the engaging grooves 152 of the armrests 15 so as to position the back frame 12 at a desired inclination.

Although the armrests 15 permit adjustment of the inclination of the back frame 12, the adjustment as such is limited by the number of the engaging grooves 152. The armrests 15 do not permit stepless adjustment of the inclination of the back frame 12 to suit a user's requirement, and are not satisfactory.

SUMMARY OF THE INVENTION

Therefore, the object of the present invention is to provide an armrest which permits stepless adjustment of the inclination of a back frame of a chair.

Accordingly, the armrest of the present invention is to be used in a chair which includes an upright back frame, a horizontal seat frame having a rear end pivoted to a bottom end of the back frame, and a leg frame having a bottom end supported on a ground surface and a top end. The armrest includes a hollow horizontal armrest frame, a mounting seat, a shaft, a locking plate and a biasing spring. The armrest frame has a rear end adapted to be mounted pivotally on a lateral side of the back frame. The armrest frame is formed with a longitudinally extending channel that has a bottom opening. The mounting seat is disposed in the channel, and has a front end and a rear end which is adapted to be mounted pivotally on the top end of the leg frame. The mounting seat has opposite front and rear walls at the front and rear ends respectively, and a parallel pair of side walls that interconnect the front and rear walls so as to define a space among the front, rear and side walls. The front and rear walls are formed with aligned through holes that have an axis parallel to the armrest frame. Each of the side walls has an inner surface facing the space and formed with a retaining groove that is registered with the retaining groove on the other one of the side walls and that is transverse to the channel. Each of the retaining grooves is defined by a vertical shoulder proximate to the front wall, and an inclined shoulder distal to the front wall. The inclined shoulder inclines downwardly and forwardly relative to the vertical shoulder. The shaft extends slidably through the through holes in the front and rear walls of the mounting seat, and has two opposite ends secured to the armrest frame. The locking plate is disposed in the space of the mounting seat, and has opposite vertical edges that extend respectively into the retaining grooves. The locking plate has upper and lower sections, and is formed with a locking hole between the upper and lower sections. The locking hole is defined by a hole-defining peripheral wall, and is slightly larger than cross-section of the shaft to permit extension of the shaft therethrough. The locking plate is movable between a locking position, in which the locking plate abuts against the inclined shoulders on the side walls of the mounting seat and in which the locking plate inclines relative to the shaft such that the hole-defining peripheral wall of the locking plate frictionally engages the shaft for locking the armrest frame at a desired position relative to the mounting seat, and a releasing position, in which the hole-defining peripheral wall of the locking plate is disengaged from the shaft to permit adjustment of relative positions between the armrest frame and the mounting seat. The biasing spring is disposed between the front wall of the mounting seat and the locking plate, and is sleeved on the shaft for biasing the locking plate to the locking position.

Preferably, the armrest further includes an operating member which is disposed under the mounting seat and which has a front end mounted pivotally on the front end of the mounting seat about a horizontal pivot axis transverse to the shaft. The operating member has a push projection that extends into the space and that is disposed posteriorly of the upper section of said locking plate. The operating member is operable to pivot about the horizontal pivot axis and move the push projection forwardly so as to push the upper section of the locking plate forwardly away from said inclined shoulders and toward the vertical shoulders on the side walls of the mounting seat against biasing action of the biasing spring for moving the locking plate from the locking position to the releasing position.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
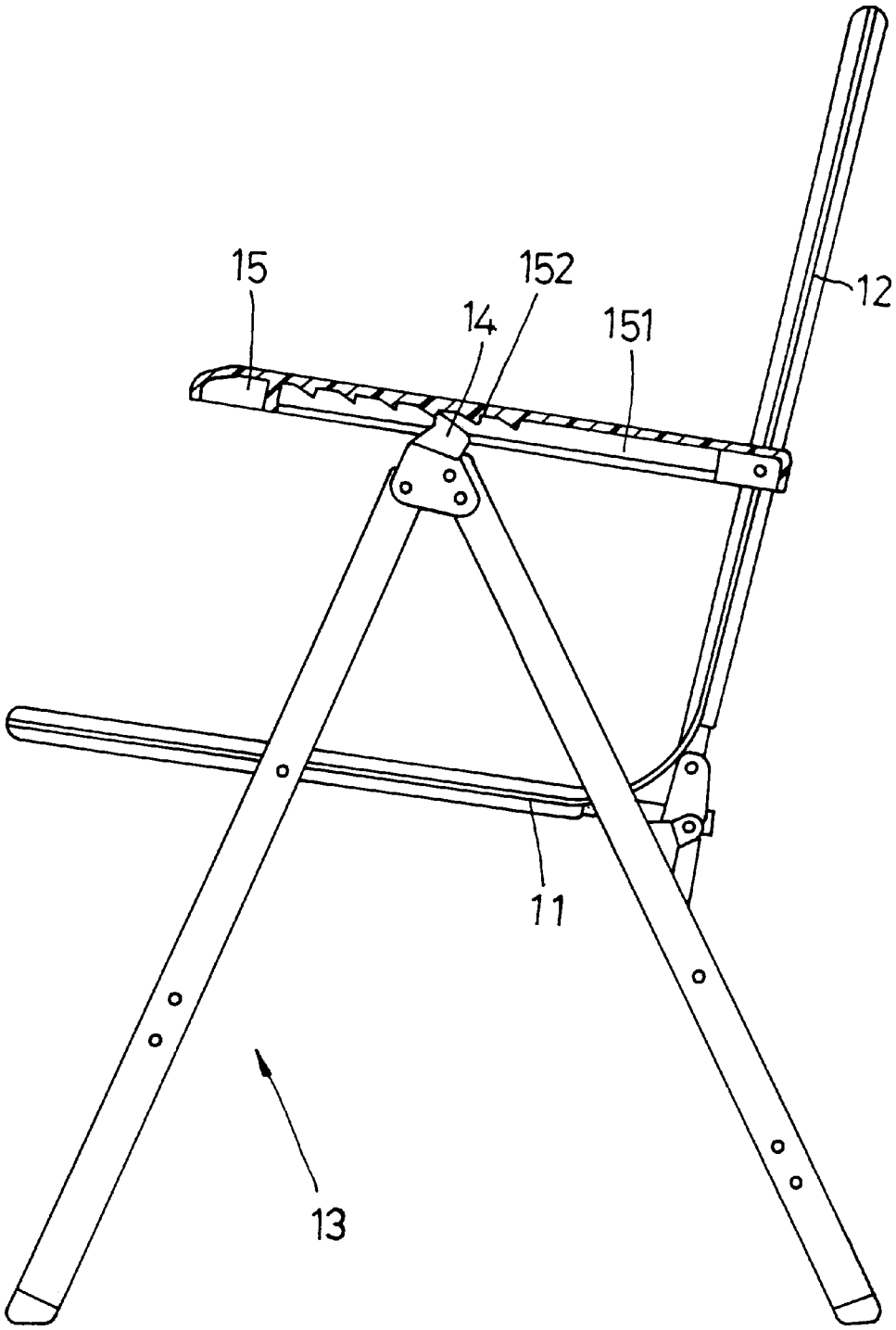
FIG. 1 PRIOR ART
FIG. 1 is a partly sectional side view of a conventional chair.
Figure 2:
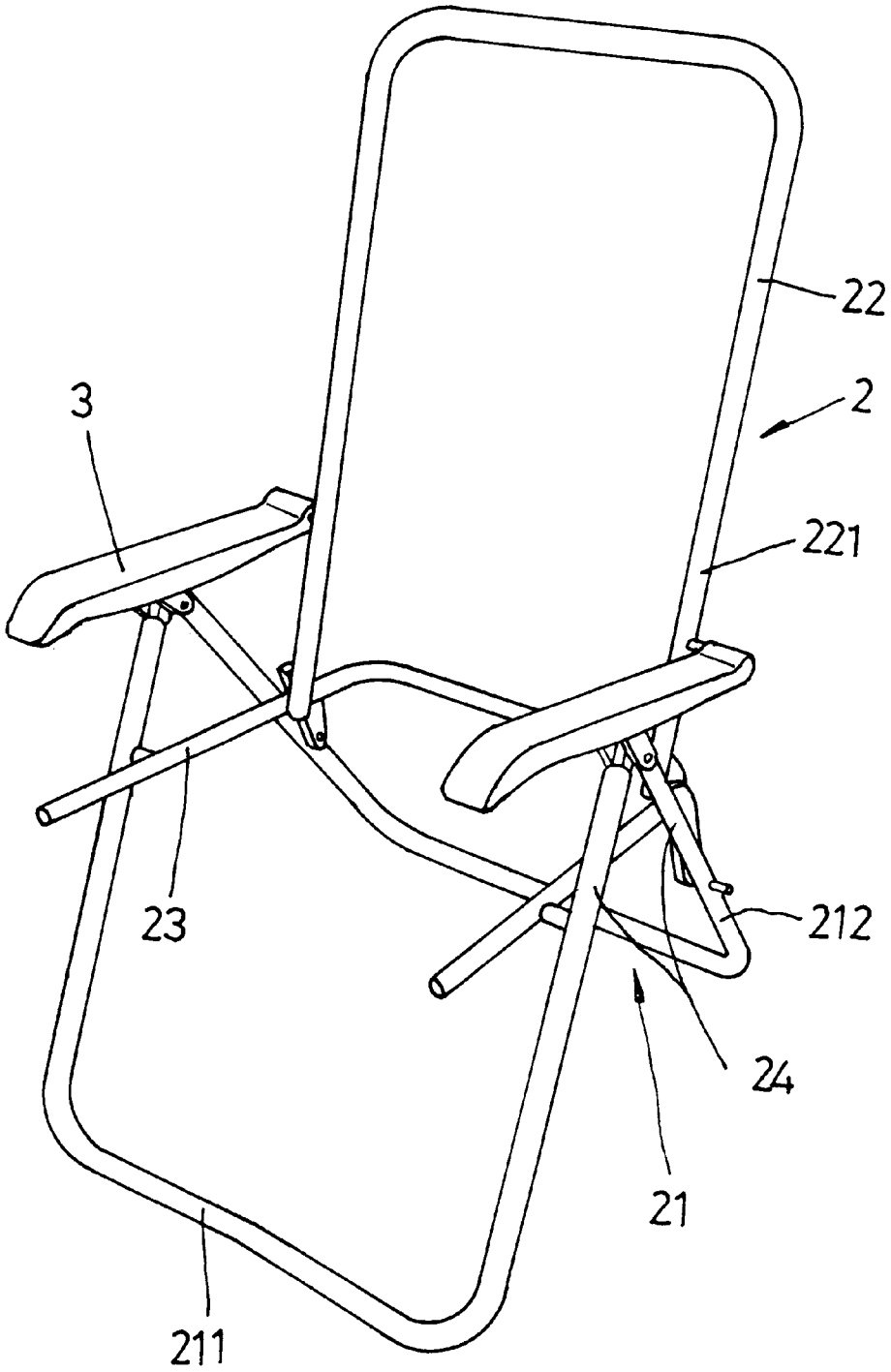
FIG. 2 is a perspective view of a chair incorporating a pair of armrests according to a preferred embodiment of the present invention.

Referring to FIG. 2, the armrest 3 of the preferred embodiment of the present invention is adapted to be used in a leisure chair 2 which includes a leg frame 21, an inverted U-shaped upright back frame 22, and a U-shaped horizontal seat frame 23. The leg frame 21 includes a U-shaped front leg 211 which inclines forwardly and downwardly, and a U-shaped rear leg 212 which inclines rearwardly and downwardly. Each of the front and rear legs 211, 212 has a bottom rail adapted to be supported on a ground surface, and top ends 24. The back frame 22 includes two lateral rods 221 on opposite lateral sides thereof. The seat frame 23 has two opposite lateral rails with rear ends connected pivotally and respectively to bottom ends of the lateral rods 221 of the back frame 22.

A pair of the armrests 3 of the preferred embodiment of the present invention are to be mounted on the lateral rods 221 of the back frame 22 and on the top ends 24 of the front and rear legs 211, 212 above the seat frame 23.

Figure 3:
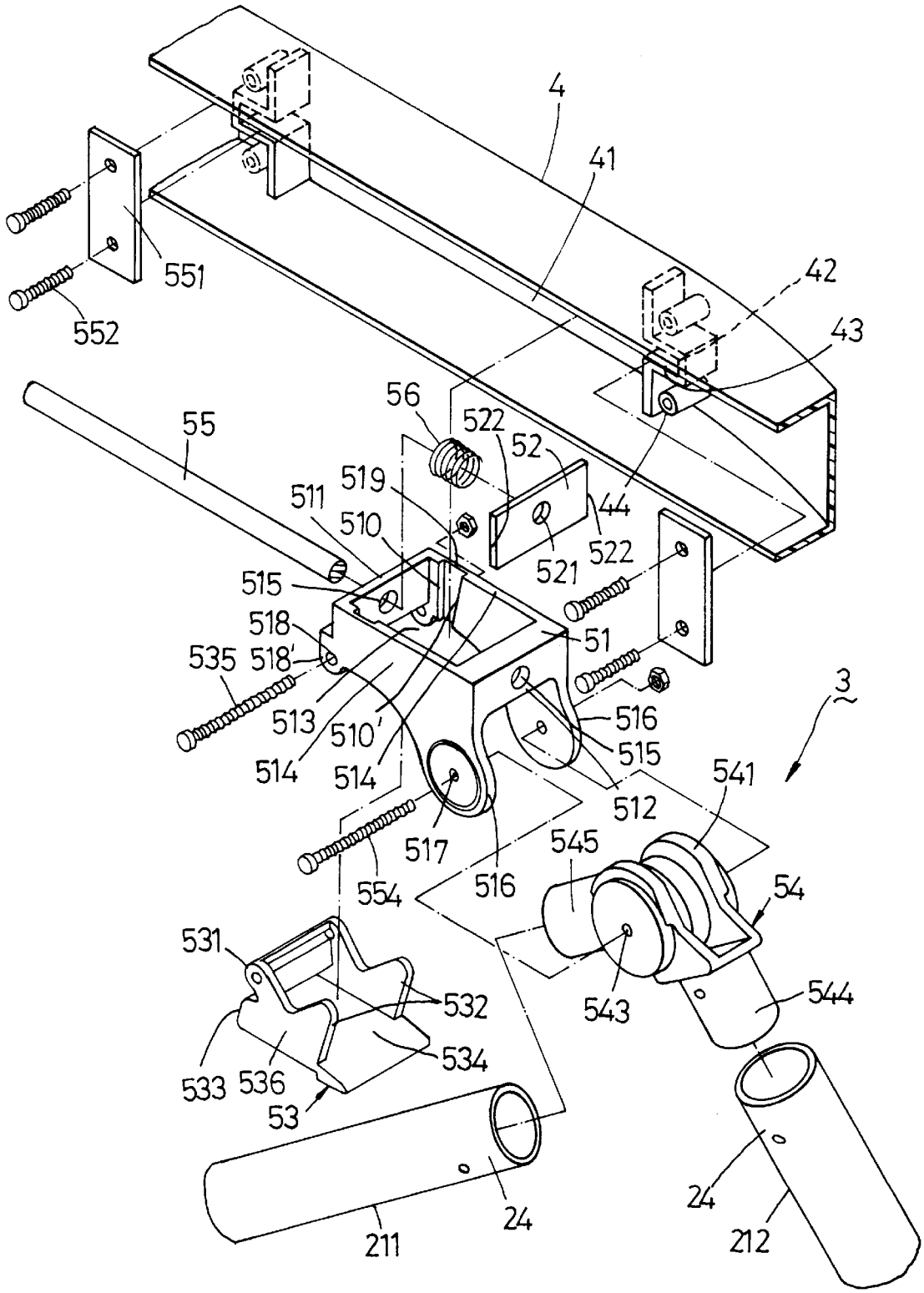
FIG. 3 is a fragmentary exploded perspective view of the armrest of the preferred embodiment.
Figure 4:
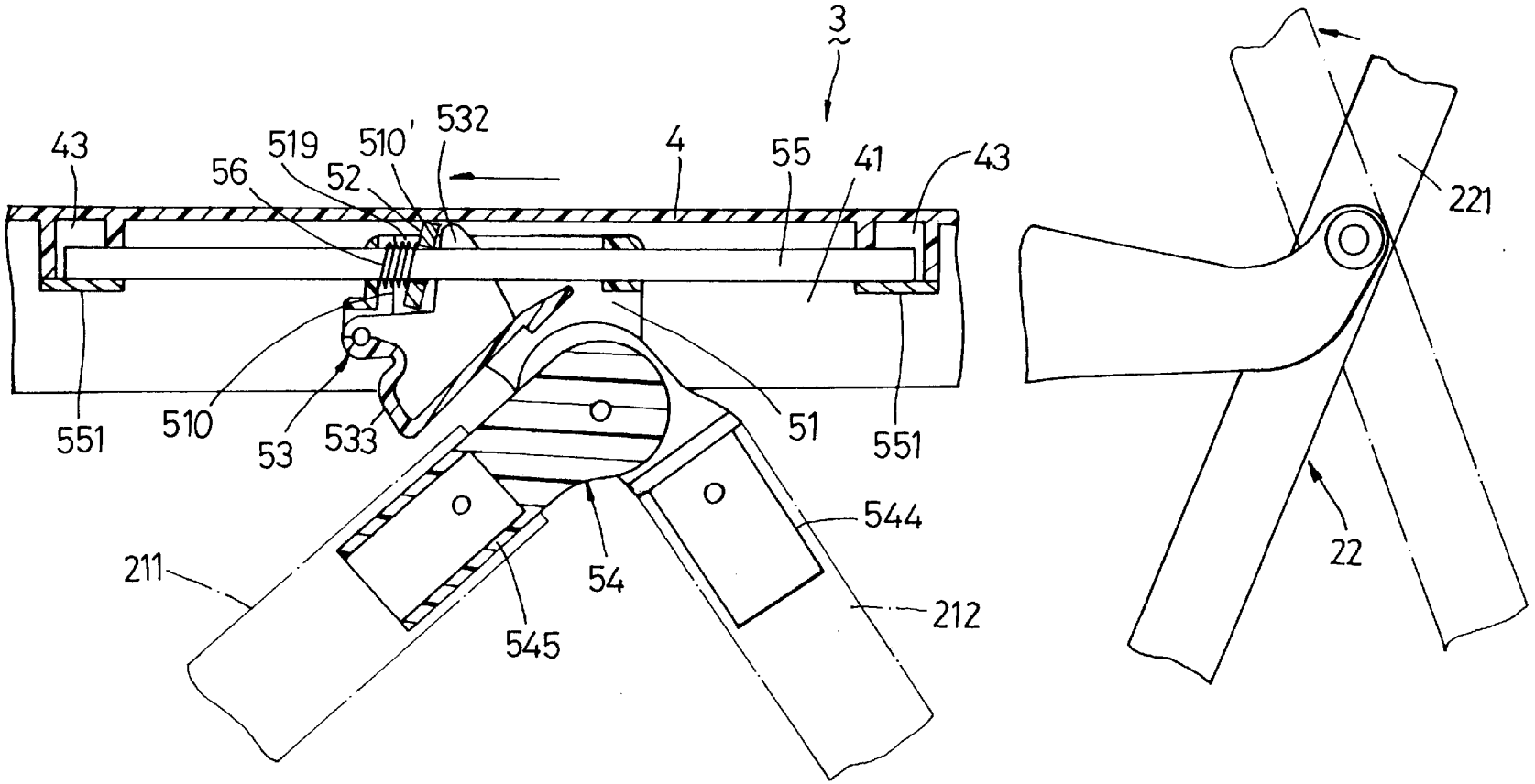
FIG. 4 is a fragmentary sectional view of the armrest of the preferred embodiment.

Referring to FIGS. 3 and 4, each of the armrests 3 includes a horizontal armrest frame 4, a mounting seat 51, a shaft 55, a locking plate 52, a biasing spring 56, an operating member 53, and a connector 54.

The armrest frame 4 is formed as a hollow elongated body with an inverted U-shaped cross-section, and has a rear end adapted to be mounted pivotally on a respective lateral rod 221 of the back frame 22. The armrest frame 4 is formed with a longitudinally extending channel 41 with a bottom opening, and front and rear positioning units 42 in the channel 41. Each of the positioning units 42 has a receiving space 43 that opens toward the receiving space 43 of the other one of the positioning units 42. Each of the positioning units 42 further includes a pair of positioning tubes 44 formed on opposite sides outside of the respective receiving space 43.

The mounting seat 51 is disposed in the channel 41 of the armrest frame 4 via the bottom opening. The mounting seat 51 has a front wall 511 at a front end, a rear wall 512 at a rear end, and a pair of side walls 514 interconnecting the front and rear walls 511, 512 so as to define a space 513 among the front, rear and side walls 511, 512, 514. The front and rear walls 511, 512 are formed with aligned through holes 515 that have an axis parallel to the armrest frame 4. Each of the side walls 514 is formed with a first pivot lobe 518' at the front end of the mounting seat 51, and a second pivot lobe 516 at the rear end of the mounting seat 51. The first pivot lobes 518' are formed with aligned first pivot holes 518. The second pivot lobes 516 are formed with aligned second pivot holes 517. Each of the side walls 514 has an inner surface facing the space 513 and formed with a retaining groove 519 that is registered with the retaining groove 519 formed in the other one of the side walls 514 and that is transverse to the channel 41. Each of the retaining grooves 519 is defined by a vertical shoulder 510 proximate to the front wall 511, and an inclined shoulder 510' distal to the front wall 511. The inclined shoulder 510' is spaced apart from the vertical shoulder 510, and inclines downwardly and forwardly relative to the vertical shoulder 510.

The shaft 55 extends slidably through the aligned through holes 515 in the front and rear walls 511, 512 of the mounting seat 51, and has two opposite ends extending respectively into the receiving spaces 43 in the positioning units 42 of the armrest frame 4. The shaft 55 is retained securely in the receiving spaces 43 by means of a pair of fastening plates 551 that are fastened to the positioning tubes 42 by means of screw fasteners 552.

The locking plate 52 is disposed in the space 513 of the mounting seat 51, and has opposite vertical edges 522 that extend respectively into the retaining grooves 519 in the side walls 514. The locking plate 52 has upper and lower sections, and is formed with a locking hole 521 between the upper and lower sections. The locking hole 521 is slightly larger than the cross-section of the shaft 55 to permit extension of the shaft 55 therethrough.

The biasing spring 56 is sleeved on the shaft 55 and is disposed between the front wall 511 of the mounting seat 51 and the locking plate 52 for biasing the locking plate 52 rearwardly to a locking position, in which the locking plate 52 abuts against the inclined shoulders 510' of the side walls 514 and in which the locking plate 52 inclines relative to the shaft 55 such that a hole-defining peripheral wall that defines the locking hole 521 frictionally engages the shaft 55 for locking the armrest frame 4 at a desired position relative to the mounting seat 51, as shown in FIG. 4.

The operating member 53 is disposed under the mounting seat 51, and has a pivot portion 531 formed at a front end thereof. The pivot portion 531 is disposed between the first pivot lobes 518' of the mounting seat 51 and is mounted pivotally on the front end of the mounting seat 51 by means of a horizontal pivot pin 535 that extends in a direction transverse to the shaft 55 through the first pivot holes 518 and through the pivot portion 531 of the operating member 53. The operating member 53 further has an operating projection 533 formed below the pivot portion 531, and a pair of side walls 536 extending rearwardly from the pivot portion 531 and the operating projection 533. Each of the side walls 536 has a push projection 532 that extends into the space 53 of the mounting seat 51 and that is disposed posteriorly of the upper section of the locking plate 52. The operating member 53 further has a connecting wall 534 interconnecting lower edges of the side walls 536 for reinforcing purposes.

The connector 54 has a pivot joint portion 541 disposed between the second pivot lobes 516 of the mounting seat 51, and two connecting portions 544, 545 that extend from the pivot joint portion 541 and that are adapted to be extended into the corresponding top ends 24 of the rear and front legs 212, 211 for connecting with latter. The pivot joint portion 541 is mounted on the rear end of the mounting seat 51 by means of a horizontal pivot pin 554 that extends in a direction transverse to the armrest frame 4 through the second pivot holes 517 in the second pivot lobes 516 and through a pivot hole 543 formed in the pivot joint portion 541 of the connector 54.

Referring to FIG. 4, before the operating member 53 is operated, the locking plate 52 abuts against the inclined shoulders 510' on the side walls 514 of the mounting seat 51 due to the biasing action of the biasing spring 56. At this time, a hole-defining peripheral wall that defines the locking hole 521 frictionally engages the shaft 55 for locking the armrest frame 4 at the desired position relative to the mounting seat 51. The back frame 22 is thus locked at a desired inclination relative to the seat frame 23 (see FIG. 2).

When it is desired to adjust the inclination of the back frame 22, such as to turn the back frame 22 forwardly relative to the seat frame 23, the armrest frame 4 is simply pulled forwardly to result in forward pivoting movement of the back frame 22 relative to the seat frame 23. At this time, the shaft 55 is moved forwardly together with the armrest frame 4 relative to the mounting seat 51. Since the hole-defining peripheral wall of the locking hole 512 frictionally engages the shaft 55, the upper section of the locking plate 52 can be moved forwardly by the shaft 55 away from the inclined shoulders 510' to a releasing position, in which the locking plate 52 is disengaged from the shaft 55 to permit adjustment of relative positions between the armrest frame 4 and the mounting seat 51. When the forward pulling force applied to the armrest frame 4 is released, the locking plate 52 inclines to frictionally engage the shaft 55 once again due to the rearward biasing force applied by the biasing spring 56.

Figure 5:
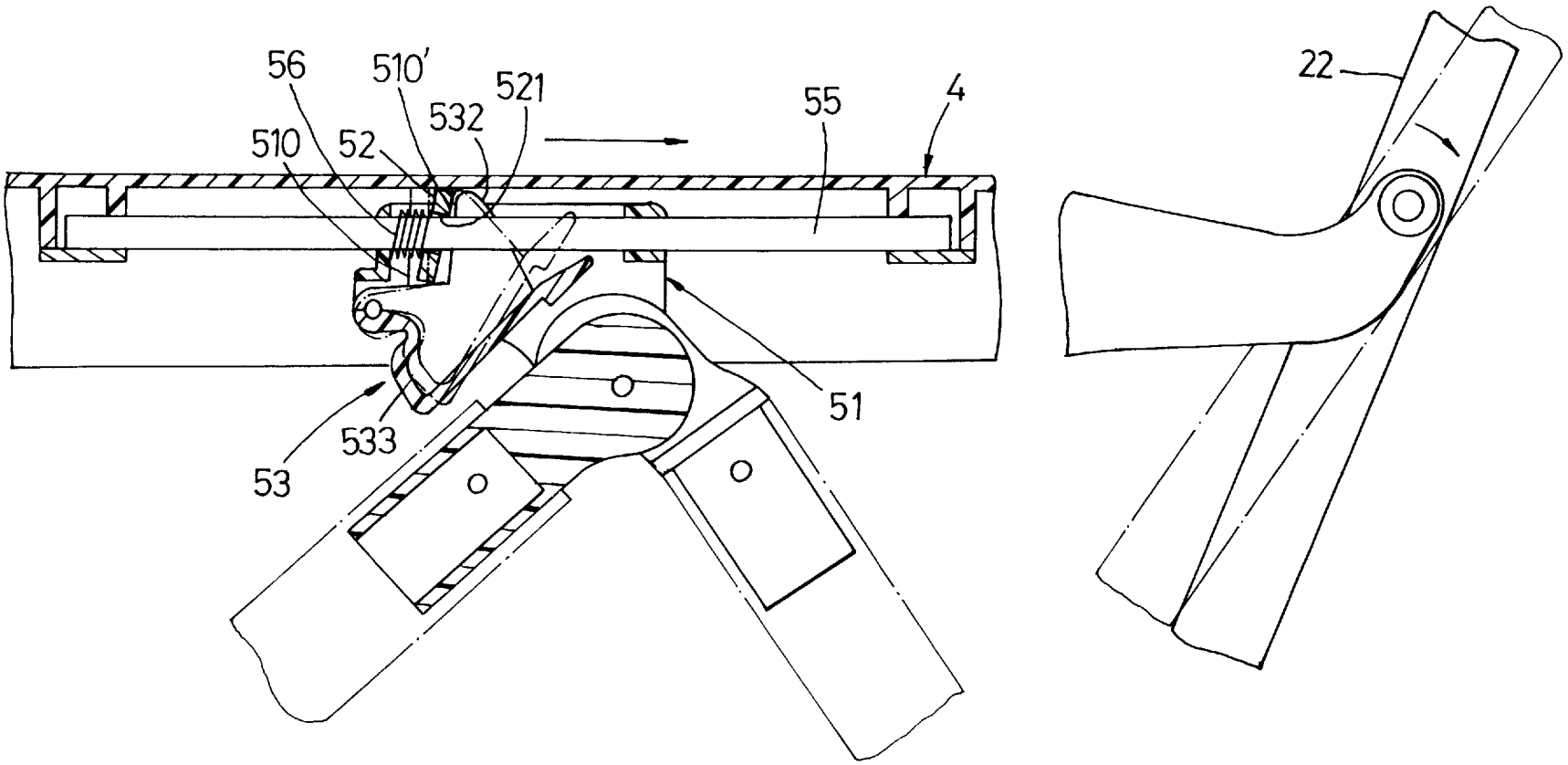
FIG. 5 is another fragmentary sectional view of the armrest of the preferred embodiment, illustrating how the armrest can be operated to adjust the inclination of a back frame of the chair.

Referring to FIG. 5, when it is desired to turn the back frame 22 rearwardly relative to the seat frame 23, the operating projection 533 is pushed rearwardly to move the push projections 532 forwardly so as to push the upper section of the locking plate 52 forwardly away from the inclined shoulders 510' and toward the vertical shoulders 510 on the side walls 514 of the mounting seat 51 against biasing action of the biasing spring 56 to place the locking plate 52 in the releasing position. At this time, the armrest frame 4 is permitted to move rearwardly relative to the mounting seat 51 to result in rearward pivoting of the back frame 22 relative to the seat frame 23. When the pushing force applied to the operating projection 533 of the operating member 53 is released, the locking plate 52 is once again biased to the locking position by the biasing spring 56.

It has thus been shown that the armrest of the present invention, when installed on a chair as shown in FIG. 2, permits stepless adjustment of the inclination of the back frame 22 to suit the requirement of a user. In addition, the adjustment operation is relatively easy to conduct.

With this invention thus explained, it is apparent that numerous modifications and variations can be made without departing from the scope and spirit of this invention. It is therefore intended that this invention be limited only as indicated in the appended claims.

I claim:

1. An armrest for use in a chair which includes an upright back frame, a horizontal seat frame having a rear end pivoted to a bottom end of the back frame, and a leg frame having a bottom end supported on a ground surface and a top end, said armrest comprising:

a hollow horizontal armrest frame having a rear end adapted to be mounted pivotally on a lateral side of the back frame, said armrest frame being formed with a longitudinally extending channel that has a bottom opening;

a mounting seat disposed in said channel, said mounting seat having a front end and a rear end which is adapted to be mounted on the top end of the leg frame, said mounting seat having opposite front and rear walls at said front and rear ends respectively, and a parallel pair of side walls that interconnect said front and rear walls so as to define a space among said front, rear and side walls, said front and rear walls being formed with aligned through holes that have an axis parallel to said armrest frame, each of said side walls having an inner surface facing said space and formed with a retaining groove that is registered with said retaining groove on the other one of said side walls and that is transverse to said channel, each of said retaining grooves being defined by a vertical shoulder proximate to said front wall, and an inclined shoulder distal to said front wall, said inclined shoulder inclining downwardly and forwardly relative to said vertical shoulder;

a shaft extending slidably through said through holes in said front and rear walls of said mounting seat and having two opposite ends secured to said armrest frame;

a locking plate disposed in said space of said mounting seat and having opposite vertical edges that extend respectively into said retaining grooves, said locking plate having upper and lower sections and being formed with a locking hole between said upper and lower sections, said locking hole being defined by a hole-defining peripheral wall and being slightly larger than cross-section of said shaft to permit extension of said shaft therethrough, said locking plate being movable between a locking position, in which said locking plate abuts against said inclined shoulders on said side walls of said mounting seat and in which said locking plate inclines relative to said shaft such that said hole-defining peripheral wall of said locking plate frictionally engages said shaft for locking said armrest frame at a desired position relative to said mounting seat, and a releasing position, in which said hole-defining peripheral wall of said locking plate is disengaged from said shaft to permit adjustment of relative positions between said armrest frame relative to said mounting seat; and a biasing spring disposed between said front wall of said mounting seat and said locking plate and sleeved on said shaft for biasing said locking plate to said locking position.

2. The armrest as claimed in claim 1, further comprising:

an operating member disposed under said mounting seat and having a front end mounted pivotally on said front end of said mounting seat about a horizontal pivot axis transverse to said shaft, said operating member having a push projection extending into said space and disposed posteriorly of said upper section of said locking plate, said operating member being operable to pivot about said horizontal pivot axis and move said push projection forwardly so as to push said upper section of said locking plate forwardly away from said inclined shoulders and toward said vertical shoulders on said side walls of said mounting seat against biasing action of said biasing spring for moving said locking plate from the locking position to the releasing position.

3. The armrest as claimed in claim 1, wherein said armrest frame has an inverted U-shaped cross-section.

4. The armrest as claimed in claim 1, wherein each of said side walls of said mounting seat is formed with a pivot lobe at said rear end of said mounting seat, said armrest further comprising:

a connector which has a pivot joint portion disposed between said pivot lobes, and a connecting portion extending from said pivot joint portion and adapted to be connected to the top end of the leg frame; and a horizontal pivot shaft extending through said pivot lobes and said pivot joint portion in a direction transverse to said armrest frame for mounting said connector pivotally on said rear end of said mounting seat.

* * * * *